US005243913A

United States Patent [19]

Brent et al.

[11] Patent Number: 5,243,913

[45] Date of Patent: Sep. 14, 1993

[54] SHOCK TUBE INITIATOR

[75] Inventors: Geoffrey F. Brent, Dundonald; Malcolm D. Harding, Irvine, both of Scotland

[73] Assignee: Imperial Chemical Industries PLC, London, England

[21] Appl. No.: 937,605

[22] Filed: Sep. 2, 1993

[30] Foreign Application Priority Data

Sep. 9, 1991 [GB] United Kingdom ..... 9119220

[51] Int. Cl.[5] ..... C06C 5/00

[52] U.S. Cl. ..... 102/275.8; 149/123

[58] Field of Search ..... 102/275.5, 275.8; 149/123

[56] References Cited

U.S. PATENT DOCUMENTS

| | | | |
|---|---|---|---|
| 3,590,739 | 7/1971 | Persson | 102/275.8 |
| 4,222,330 | 9/1980 | Krystyniak | 149/123 X |
| 4,328,753 | 5/1982 | Kristensen et al. | 102/275.8 X |
| 4,363,678 | 12/1982 | Nishimura et al. | 149/123 X |
| 4,493,261 | 1/1985 | Simon et al. | 102/275.8 X |
| 4,537,645 | 8/1985 | Yamaguchi et al. | 149/123 X |
| 4,607,573 | 8/1986 | Thureson et al. | 102/275.8 X |
| 4,640,035 | 2/1987 | Kind et al. | 102/275.8 X |
| 5,166,470 | 11/1992 | Stewart | 102/275.8 X |

*Primary Examiner*—Peter A. Nelson

*Attorney, Agent, or Firm*—Cushman, Darby & Cushman

[57] ABSTRACT

A shock tube initiator comprises a plastics tubing having an unobstructed axial bore, said tubing having throughout its length an inner surface upon which unconsolidated reactive materials are provided as a loosely adherent dusting of shock-dislodgeable particles at a core loading sufficiently low to avoid rupture of the tubing in use, wherein said reactive materials comprise flake metallic fuel particles having a surface colouring layer of pigment, e.g. $Fe_2O_3$ whereby on firing of the core charge the residue is visibly of a different colour, hue, or shade.

12 Claims, 1 Drawing Sheet

SHOCK TUBE INITIATOR

FIELD OF THE INVENTION

This invention concerns blasting operations in which shock-tube or signal-tube transmission systems are used.

BACKGROUND OF THE INVENTION

Shock tubes and signal tubes are classes of low-energy fuse used in blasting systems for transmitting an initiation signal from one point to another (usually from one detonator or pyrotechnic delay to another), such tubes being constructed of plastic, usually extruded and unreinforced, and containing a particular detonating or rapid reacting pyrotechnic composition distributed substantially uniformly along its central core at relatively low loadings compared to common detonating cords. The particulate composition is loosely adherent to the inner wall of the tube so that it is shock-dislodgeable. The internal bore of the tubing is usually narrow, and is normally circular (though it need not be). Shock tube, for example, will typically consist of extruded plastic tube of internal diameter around 1 mm with a core loading of, say, HMX/AL (94:6 parts by weight) of below 20 mg/m. Signal tube designed for lower signal transmission speeds (i.e. significantly below 2 km/s) will have similar dimensions, and will contain a rapid reacting pyrotechnic composition comprising a metal fuel e.g. Al or quasi-metal fuel such as Si and a powerful inorganic oxidising agent (especially $BaO_2$) typically at a core loading of around 20 mg/m to 100 mg/m. Reference may be made to European Patent No. 327 219 (ICI) for further information on shock tube products.

In field or mine situations it is not always immediately apparent to a blast engineer that a particular tube has fired merely from visual inspection of the still intact tube. This is in part because the visible colour change of the core material upon detonation or reaction may not be significant, especially at low core loadings. A further reason is that accessories producers prefer to supply coloured products and so the plastic of the shock/signal tube usually will be self-coloured, thus masking to a significant degree any core colour change that might otherwise have been perceptible. Additionally, natural or artificial light levels, especially underground, are not always at an intensity or spectral breadth conducive to perceiving a colour change in core material.

The Applicants have experimented with adding reactive pigment particles to the shock/signal tube core charge. The results were generally poor because, for a noticeable colour change, levels of pigment had to be used which caused fundamental disturbance of the firing performance of the tube. The present invention has overcome this problem, allowing achievement of marked colour change while using only a relatively small amount of reactive pigment.

SUMMARY OF THE INVENTION

According to the present invention, a shock/signal tube has a core charge containing flake metallic fuel and the surface of the flake is coloured by a layer of pigment so that on firing of the core charge the metallic fuel is consumed, the pigment is dispersed, consumed or destroyed, and the residue is visibly of a different colour, hue, or shade.

The core charge may be of the metal fuel/secondary explosives type, e.g. Al/HMX, or the metal fuel/oxidiser type, e.g. Al/$BaO_2$.

The pigment is most suitably a self-coloured metal oxide, preferably one that is an oxidising agent at high temperatures. Especially suitable is vapour-deposited $Fe_2O_3$; it is effective at low deposition levels and does not adversely interfere with the principal performance-determining tube reactions.

In general the pigment will make up less than 30% m/m based on the mass of the coloured metal flake, and will coat both sides of the flake.

Obviously, any bulk colouring of the plastics tube would have to be matched to the colour change of the core charge so that the colour change is not masked.

A further benefit which may result from metal flake coating with pigment is that the flakes may be rendered non conducting, a welcome safety advantage.

DESCRIPTION OF THE DRAWING

In the single figure attached a section through a shock or signal tube initiator is shown wherein tubing 1 has throughout its length an inner surface upon which unconsolidated reactive materials 2 are provided as a loosely adherent dusting of shock-dislodgeable particles.

EXAMPLES

Figure 1:
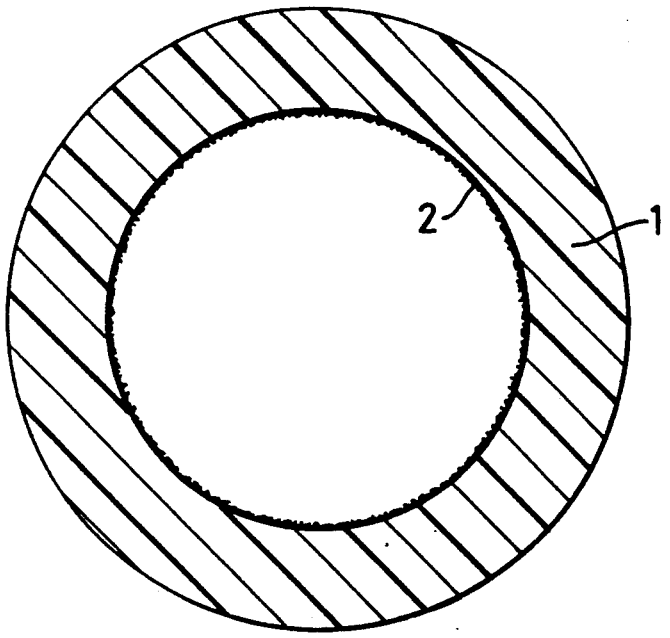

Two core charges were made up using coloured Al flake as the metal fuel and HMX and $BaO_2$, respectively, as the co-reagent. The Al flake was coated with vapour-deposited $Fe_2O_3$ sufficient to give the flake a distinct gold colour. The ratio of coated Al to co-reagent was 10:90 by weight. The c.Al/HMX mixture fired at 2050 m/s and the c.Al/$BaO_2$ mixture fired at 650 m/s at loadings of 20 mg/m and 30 mg/m respectively in clear 'Surlyn' tubing (1.3 mm I.D.). Before firing the coloured core charge was visible; after firing the tube looked clear.

We claim:

1. A shock tube initiator comprising a plastics tubing having an unobstructed axial bore, said tubing having throughout its length an inner surface upon which a core charge of unconsolidated reactive materials are provided as a loosely adherent dusting of shock-dislodgeable particles at a core loading sufficiently low to avoid rupture of the tubing in use, wherein said reactive materials comprise flake metallic fuel particles having a surface colouring layer of pigment whereby on firing of the core charge the residue is visibly of a different colour, hue, or shade.

2. The shock tube initiator claimed in claim 1 wherein the pigment is a self-coloured metal oxide.

3. The shock tube initiator claimed in claim 2 wherein the metal oxide acts as an oxidising agent at the temperatures typically attained by firing of the shock tube.

4. The shock tube initiator claimed in claim 2 wherein the metal oxide is vapour-deposited $Fe_2O_3$.

5. The shock tube initiator claimed in claim 1 wherein the pigment makes up less than 30% m/m based on the mass of the coloured metal flake.

6. The shock tube initiator claimed in claim 1 wherein the metal flake is Al.

7. The shock tube initiator claimed in claim 6 wherein the reactive materials comprise 10 parts (by weight) coated Al flake and 90 parts (by weight) co-reagent.

8. The shock tube initiator claimed in claim 7 wherein the co-reagent comprises a secondary explosive.

9. The shock tube initiator claimed in claim 8 wherein the secondary explosive is HMX.

10. The shock tube initiator claimed in claim 7 wherein the co-reagent comprises a powerful inorganic oxidising agent.

11. The shock tube initiator claimed in claim 10 wherein the inorganic oxidising agent is $BaO_2$.

12. The shock tube initiator claimed in claim 1 wherein the core loading of reactive materials is in the range of from less than about 20 mg/m to about 100 mg/m.

* * * * *

UNITED STATES PATENT AND TRADEMARK OFFICE

CERTIFICATE OF CORRECTION

PATENT NO. : 5,243,913

DATED : September 14, 1993

INVENTOR(S) : BRENT et al.

It is certified that error appears in the above-indentified patent and that said Letters Patent is hereby corrected as shown below:

TITLE PAGE

Item [22] change "September 2, 1993" to --September 2, 1992--.

Signed and Sealed this

Fifth Day of April, 1994

Bruce Lehman

*Attest:*

BRUCE LEHMAN

*Attesting Officer*

*Commissioner of Patents and Trademarks*